US005236019A

United States Patent [19]

Pages

[11] Patent Number: 5,236,019

[45] Date of Patent: Aug. 17, 1993

[54] MOUNTING ARRANGEMENT FOR A DOBBY SWINGING LEVER

[75] Inventor: Jean-Pierre Pages, Faverges, France

[73] Assignee: S.A. Des Etablissements Staubli, Faverges, France

[21] Appl. No.: 910,713

[22] Filed: Jul. 7, 1992

[30] Foreign Application Priority Data

Jul. 15, 1991 [FR] France ..... 91 09117

[51] Int. Cl.[5] ..... D03C 1/06; D03C 1/14; D03C 1/20

[52] U.S. Cl. ..... 139/71

[58] Field of Search ..... 139/71, 72-74

[56] References Cited

U.S. PATENT DOCUMENTS 4,442,869 4/1984 Speich et al. ..... 139/71
4,947,899 8/1990 Cremonesi ..... 139/71
5,070,911 12/1991 Palau et al. ..... 139/71

FOREIGN PATENT DOCUMENTS 1942437 3/1971 Fed. Rep. of Germany .
3419719 11/1985 Fed. Rep. of Germany .
2651803 3/1991 France .

*Primary Examiner*—Andrew M. Falik
*Attorney, Agent, or Firm*—Dowell & Dowell

[57] ABSTRACT

A double-lift dobby of the Hattersley type, which includes swinging levers carried by moveable connecting rods wherein each connecting rod includes a slot in which an idle roller secured to the dobby frame is engaged. The edges of each slot define opposite tracks which guide the trajectory of each connecting rod during its full stroke.

4 Claims, 4 Drawing Sheets

MOUNTING ARRANGEMENT FOR A DOBBY SWINGING LEVER

BACKGROUND OF THE INVENTION

1. Field of the Invention

The present invention relates to double-lift dobbies of the HATTERSELY type, intended for forming the shed on weaving machines.

2. History of Related Art

It is known that, in the dobbies of the HATTERSLEY type, each of the heddle frames of the weaving machine is connected to a rocking lever which is equipped with a swinging lever of which each of the end supports a coupling member in the form of a drawing hook. Each hook is capable of coming into engagement with a traction member constituted by a reciprocating knife adapted to displace the swinging lever and its heddle frame as a function of the weaving program of the system. In the conventional construction, the system acts on the drawing hooks which are displaced so as either to cooperate with the corresponding traction member or to avoid it.

To operate dobbies of this type in a more supple manner to attain higher operational speeds, it has been proposed, particularly in document DE-A-3 419 719 (KAISER), to mount the swinging lever, no longer directly on the end of the rocking lever connected to the heddle frame, but on a connecting rod connected to the rocking lever.

For the coupling members carried by each swinging lever to be abe to cooperate reliably with the knifes or other traction members, it is, of course, necessary that the intermediate connecting rod which supports the swinging lever be suitably guided in a longitudinal direction. However, it should be observed that such guiding is particularly delicate to ensure due to the tacking or loose zig-zag displacement of the connecting rod generated by the lateral offset of the pivot axis of the rocking lever to which the connecting rod is coupled.

In document DE-A-3 419 719 (KAISER) mentioned above, the end of the connecting rod extends beyond the pivot of the swinging lever and it is at this end that longitudinal guiding is effected. It will be understood that the tacking movement mentioned above makes it necessary to arrange a larger operational clearance, which clearance involves effects of friction which generate detrimental vibrations; furthermore, guiding by friction wears the contact surfaces in contact and heat is created which is detrimental to the correct functioning of the assembly.

It is a particular object of the present invention to overcome these drawbacks.

SUMMARY OF THE INVENTION

This invention relates to a double-lift dobby of the HATTERSELY type for weaving machines, in which each of the swinging levers carries the coupling member which cooperate, under the control of the programmed selection system, with oscillating traction members, it supported by a longitudinal connecting rod. One end of each connecting rod is coupled to a rocking lever connected to a heddle frame. The opposite end of each connecting rod connected to a swinging lever has a longitudinal slot therein, inside which is engaged an idle guiding roller mounted to the frame of the machine. The slot defines for the roller two distinct bearing and rolling tracks which are individually adapted to control the path of the connecting rod and which join at rounded ends of the slot to position said connecting rod precisely at the ends of its stroke, i.e. at the moment when coupling members such as hooks carried by the swinging lever must precisely cooperate with traction members.

BRIEF DESCRIPTION OF THE DRAWINGS

The invention will be more readily understood on reading the following description with reference to the accompanying drawings, in which.

DETAILED DESCRIPTION OF THE DRAWINGS

In order to set forth the invention in detail, it has been assumed that the HATTERSLEY dobby described is of the negative type with drawn swinging levers, of the type disclosed in document FR-A-2 651 803 (STAUBLI) and in which the selection system containing the weaving program acts on the traction members and not on the hooks or other coupling members carried by the swinging levers.

Figure 1:
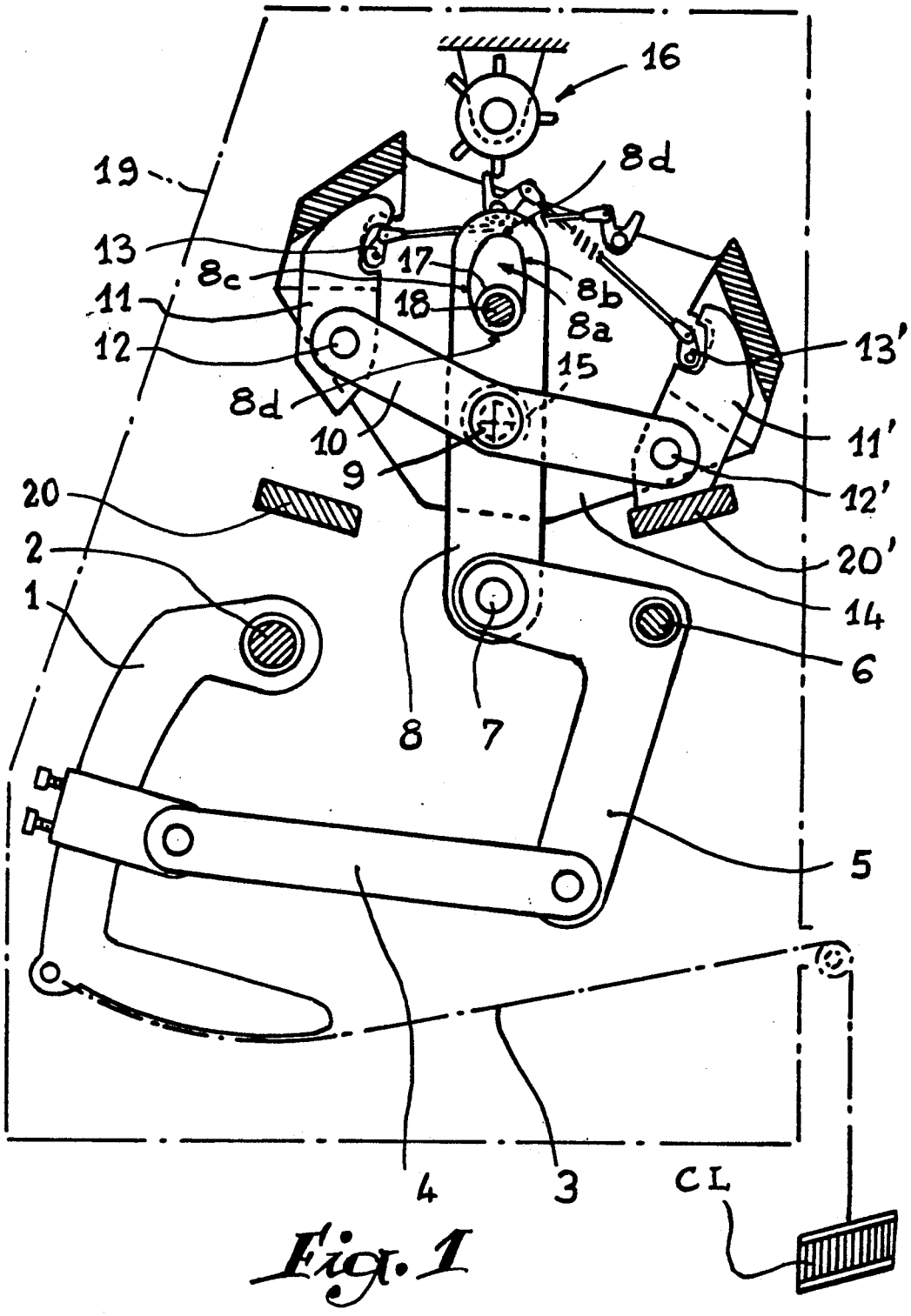
FIG. 1 is a transverse section showing the general arrangement of a dobby according to the invention.
Figure 2:
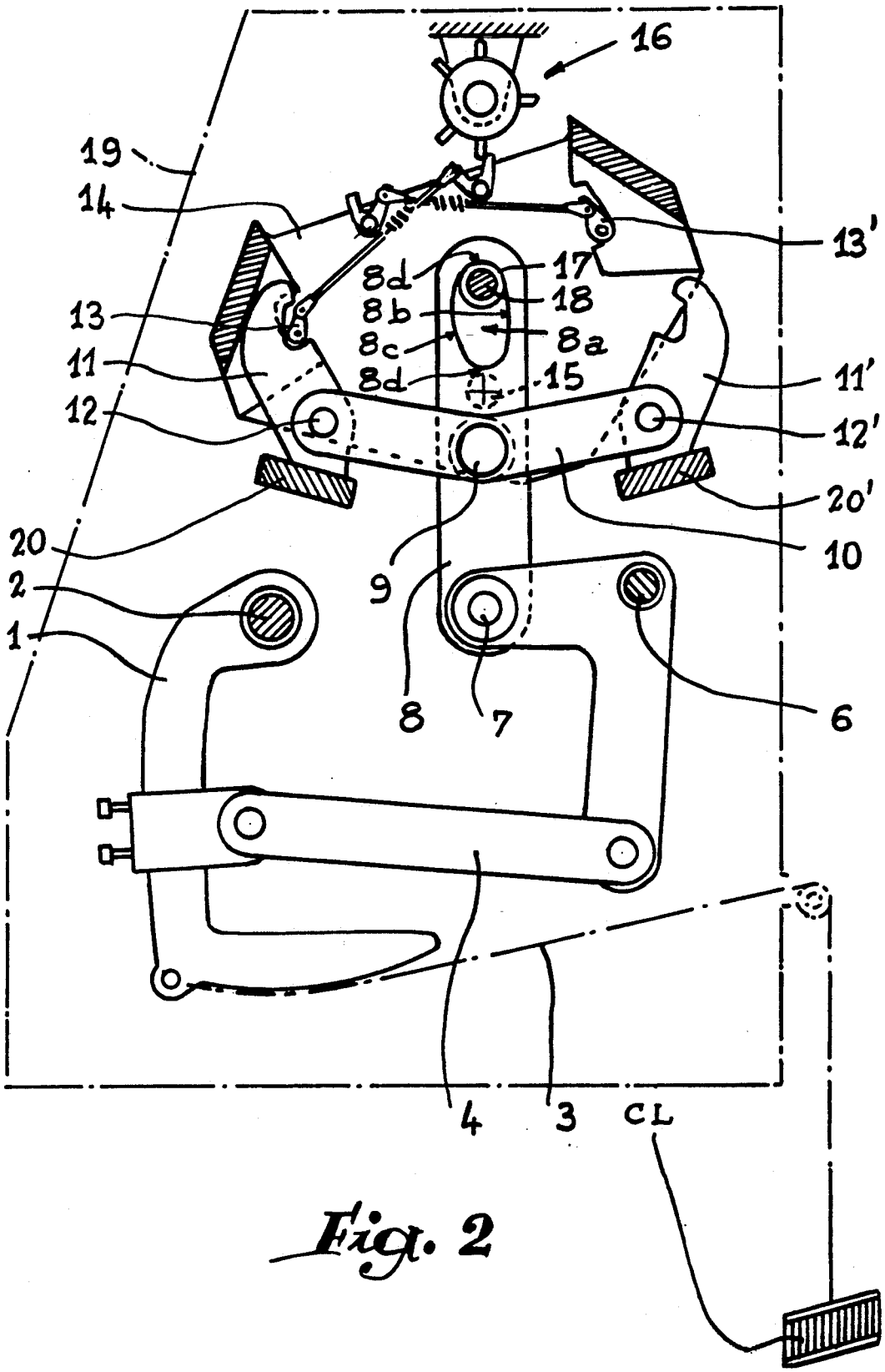
FIG. 2 reproduces FIG. 1 with the moveable elements of the dobby in another position.

Referring now to the drawings, and firstly to FIGS. 1 and 2, reference 1 designates one of the rocking levers of the dobby, of which one of the ends pivots on an axis 2 common to all the levers 1, while its opposite free end forms a fastening point for the drawing system 3, incorporating cables or connecting rods, connecting to a heddle frame CL. Each rocking lever 1 is coupled by a small rod 4 to a right-angled lever 5, mounted on a pivot 6 common to all levers 5. Opposite the small rod 4, each pivoting lever 5 has a pivot 7 on which is mounted a connecting rod 8 carrying a swinging lever 10.

Each connecting rod 8 is provided with a transverse pin 9 forming the point of articulation for the swinging lever 10 which is pivotally joined at its ends with two coupling members or hooks 11 and 11' which pivot have been referenced 12, 12'. With each hook 11 or 11' is associated a traction member 13, 13'. The two members 13 and 13' of the dobby are mounted to two lateral plates 14 which are reciprocally displaced about a transverse axis 15 which, in the position illustrated in FIG. 1, merges with the pivot or pin 9 of the swinging lever 10. The two traction members 13 and 13' associated with each swinging lever 10 are controlled by a selection system 16 which may be in the form of a barbed wheel adapted to actuate a connection mechanism coupled to each member 13 and 13'.

Each connecting rod 8 supporting a swinging lever has a slot **8*a* therein, substantially oriented along the longitudinal axis of the connecting rod. Inside the slot 8*a* of each connecting rod 8 is engaged a roller 17. The rollers 17 of the dobby are mounted idly on the same pin 18 which is rigidly secured to the frame 19** of the dobby.

Figure 3:
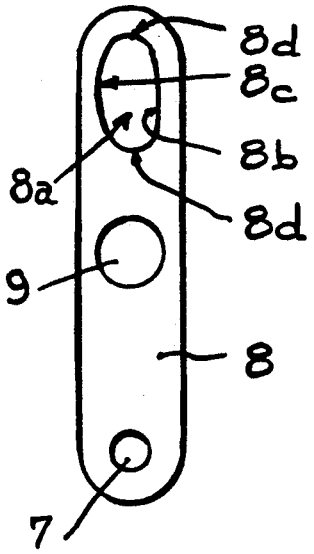
FIG. 3 is a plan view of a connecting rod.

The longitudinal edges of slot **8*a* define for the rollers 17, two opposite guiding tracks, which have been reference 8*b* and 8*c*, in FIG. 3, and which are joined at their ends by two arcuate segments 8***d* which radius corresponds substantially to that of the roller 17.

Figure 4:
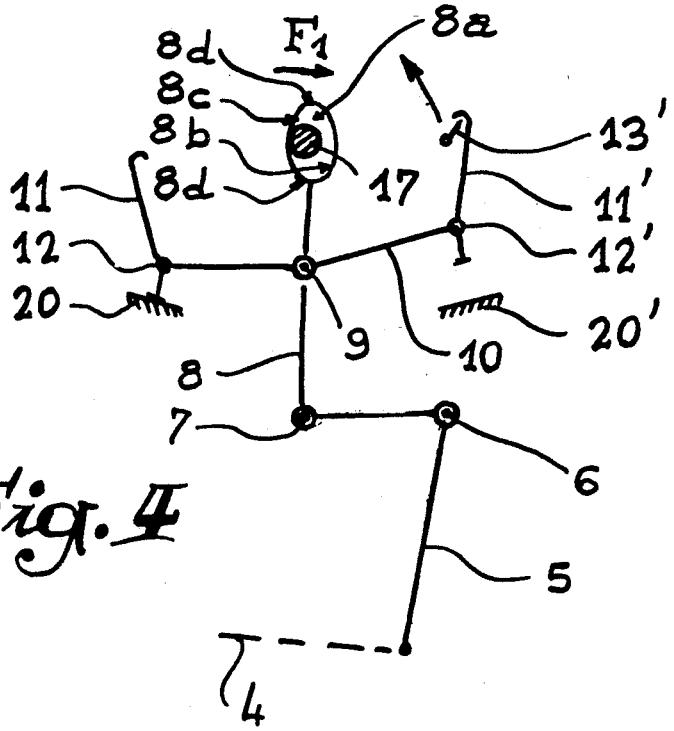
FIGS. 4 and 5 schematically illustrate the functioning of the dobby.

In FIG. 4, it has been assumed that, taking into account the control of the traction member 13', it is hook 11' which is manipulated, thus pivoting the swinging lever 10 about pivot 12 of the opposite hook 11, the hook abutting against a fixed crosspiece 20. The connecting rod 8 is thus drawn in the direction of system 16 and the equilibrium of the forces at points 7, 13' and 12 creates a resultant force (arrow F1) which maintains track 8*c* of slot 8*a* in abutment against roller 17. This track 8*c* is profiled so that, taking into account the circular trajectories of points 7 and 13', the swinging lever 10 has a circular trajectory substantially centered on point 12, which has for its effect to reduce, or even prevent, the sliding of hook 12 against the fixed crosspiece 20.

Figure 5:
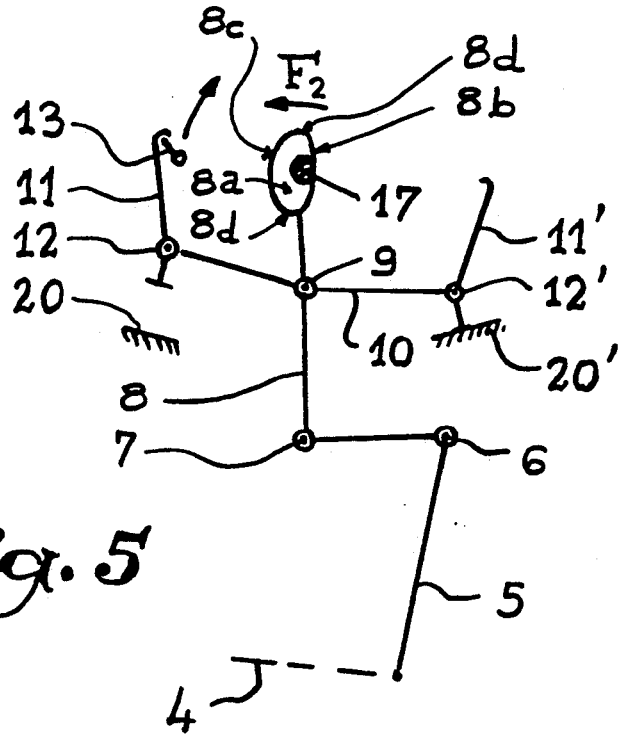

FIG. 5 illustrates the reverse situation, i.e. in the case of interaction of the traction member 13 with hook 11, and it may be verified that the same phenomena occurs in symmetrical manner, the resultant (arrow F2) applying track 8*b* against roller 17 as hook 12' abuts against a fixed crosspiece 20'.

Under these conditions, it will be readily understood that, although the connecting rod 8 carrying the swinging lever remains from free to make its tacking movement when it moves along its longitudinal axis, it is positioned perfectly when it arrives at one or the other of the two ends of its stroke at the two end parts 8*d* of FIG. 3, i.e. at the moment when the members or hooks 11 or 11' must cooperate with the traction members 13 or 13' under the control of the selection system 16. Consequently, any risk of defective actuation is avoided, even at very high operational speeds. At the same time wear is reduced by eliminating virtually all effect of friction and heating.

Figure 7:
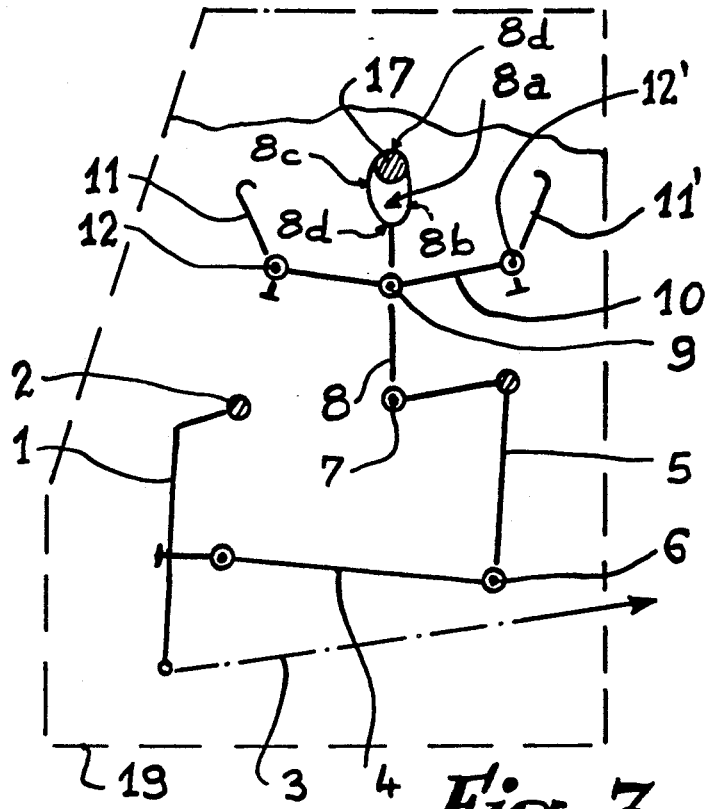
FIGS. 6 and 7 are diagrams showing alternate embodiments of the invention.
Figure 6:
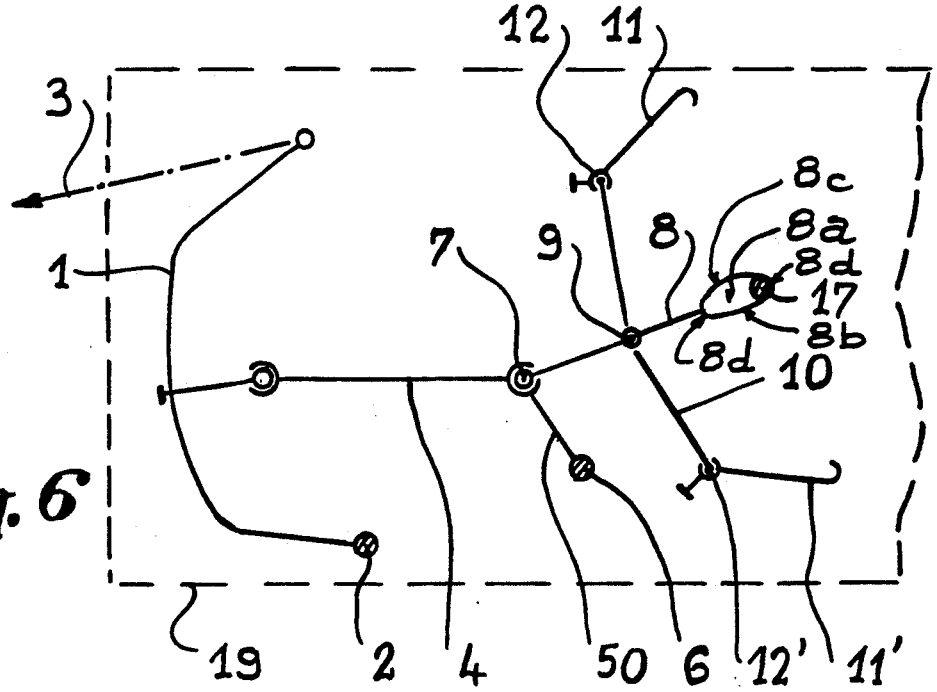

The invention may be the subject matter of different embodiments. When the dobby must present a reduced height so as to facilitate assembly thereof on the superstructure of the weaving machine, the arrangement illustrated in FIG. 6 will be adopted, where the right-angled lever 5 of FIGS. 1 and 2 is replaced by a rectilinear lever 50. On the other hand, the construction shown in FIGS. 1 and 2 and schematically shown in FIG. 7 on the same scale as in FIG. 6, presents an increased height which is suitable for dobbies intended to be directly fixed laterally at the bottom of the weaving machine wherein the reduction of the surface occupied at floor level is of greater interest.

In addition, the invention may advantageously applied to dobbies of the HATTERSELY type in which the programmed selection system acts not on the traction members 13 and 13', but on the coupling members or hooks 11 and 11' of the swinging lever.

What is claimed is:

1. In a double-lift dobby of the Hattersley type for weaving machines which include a frame, a swinging lever carrying coupling members which are actuated in response to a programmed selection system which includes oscillating traction members and wherein the swinging lever is supported by a longitudinal connecting rod having opposite ends, means for connecting one of the opposite ends of the connecting rod to a rocking lever which si connected to a heddle frame, the improvement comprising:

the other of the opposite ends of each connecting rod having a longitudinal slot therein, an idle guiding roller mounted on the frame and extending into said slot, said slot defining two spaced bearing and rolling tracks which are adapted to control the path oft he connecting rod, and said slot having rounded ends.

2. The dobby of claim 1 wherein each of said tracks in profiled to obtain a substantially symmetrical path as a function of the actuation of the coupling members.

3. The dobby of claim 1 wherein the means for connecting one of the opposite ends of the connecting rod to the rocking lever includes a rod having a first end pivotally connected to the rocking lever and a second end, a lever pivotally connected to the frame and having a first end pivotally connected to said second end of said rod and a second end pivotally connected to said one end of the connecting rod.

4. The dobby of claim 1 wherein the means for connecting one of the opposite ends of the connecting rod to the rocking lever includes a first rod having a first end pivotally connected to the rocking lever and a second end pivotally connected to said one end of the connecting rod, and a second rod pivotally connected to said second end of said first rod and said one end of said connecting rod.

* * * * *